US006339935B1

(12) United States Patent
Moretti et al.

(10) Patent No.: US 6,339,935 B1
(45) Date of Patent: Jan. 22, 2002

(54) EVAPORATOR SCROLL FOR BLOWER WHEEL

(75) Inventors: Stephen L. Moretti, Auburn; Peter R. Bushnell, Cazenovia, both of NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/859,026

(22) Filed: May 16, 2001

(51) Int. Cl.[7] ..... F25D 23/12
(52) U.S. Cl. ..... 62/262; 62/259.1; 62/411
(58) Field of Search ..... 62/262, 263, 259.1, 62/298, 411, 414; 415/211.2

(56) References Cited

U.S. PATENT DOCUMENTS 3,200,608 A * 8/1965 Glickman ..... 62/279
3,668,887 A * 6/1972 Riello ..... 62/262
4,877,106 A * 10/1989 Neville et al. ..... 181/244
4,944,654 A 7/1990 Chou
4,971,143 A * 11/1990 Hogan ..... 165/122
5,738,492 A * 4/1998 Stanko et al. ..... 415/211.1
6,045,327 A * 4/2000 Amr ..... 415/211.2

* cited by examiner

*Primary Examiner*—William Doerrler
*Assistant Examiner*—Melvin Jones
(74) *Attorney, Agent, or Firm*—Wall, Marjama & Bilinski, LLP

(57) ABSTRACT

Apparatus for radially distributing the flow leaving a centrifugal blower wheel and discharging the flow of conditioned air over the top of the indoor coil of an air conditioner unit back into the comfort region. A housing is positioned adjacent to the coil that contains a blower wheel having radially or rearwardly curved blades within a blind opening that passes inwardly from the vertical front wall of the housing. The opening has an upper section that extends across the top of the coil and a lower section that surrounds the blower wheel. The lower section includes a spiral shaped wall that connects to a linear wall that are arranged to coact with the blower to distribute air from the blower uniformly across the upper section of the opening.

16 Claims, 5 Drawing Sheets

EVAPORATOR SCROLL FOR BLOWER WHEEL

FIELD OF THE INVENTION

This invention relates generally to apparatus for uniformly distributing conditioned air across the full width of an indoor coil of an air conditioner unit.

BACKGROUND OF THE INVENTION

In U.S. Pat. No. 4,951,737 there is disclosed a packaged terminal air conditioner (PTAC) unit that has an indoor section and an outdoor section that are separated by a dividing wall. Each section contains a heat exchanger or coil and a fan for moving air over the coil surfaces. The fan utilized in the indoor section is a cross flow blower wheel fan that extends laterally across the width of the indoor coil. The cross flow blower contains a series of elongated curved blades that are spaced apart to form a cylindrical unit. The fan is driven by a motor at one end and draws return air through the indoor coil and circulates the conditioned air leaving the coil back into the comfort region. The outdoor fan servicing the outdoor coil is a centrifugal fan that requires the use of a second motor.

A similar type PTAC unit is disclosed in a later U.S. Pat. No. 4,944,654, in which the cross flow blower used in the indoor section of the unit is replaced with a centrifugal fan that is driven along with the outdoor fan by a single fan motor. The indoor fan, in this case, is equipped with forward curved blades and is mounted within a split scroll arrangement. The scroll increases in diameter to either side of a cut off point which is located at about the horizontal center line of the blower. Each section of the split scroll is a curved wall defining a logarithmic scroll, both scrolls arranged to discharge air into a plenum that extends horizontally to either side of the wheel above the indoor coil. It has been found, however, that a rather large area of reduced flow is created within the plenum that is generally located directly over the blower. A noise reducing baffle is mounted in the area of reduced flow that further impedes flow in this critical region.

It should be further noted that the size and positioning of the scrolls employed in the split scroll arrangement is limited by the available space in this part of the air conditioning unit. This, in turn, limits the amount of air that can be handled by the split scroll system. In addition, the forwarded curved blades of the blower tend to be relatively noisy.

SUMMARY OF THE INVENTION

It is therefore an object of the present invention to improve air conditioning units and, in particular, packaged terminal air conditioner (PTAC) units.

It is a further object of the present invention to improve the air handling capabilities of the indoor section of a PTAC unit.

It is a still further object of the present invention to improve the air handling capabilities of the indoor section of an air conditioning unit that employs a centrifugal blower.

Another object of the present invention is to improve the uniformity of air distribution in the indoor section of an air conditioning unit.

Yet a further object of the present invention is to reduce the amount of noise produced by a PTAC type unit.

These and other objects of the present invention are attained by air handling apparatus suitable for use in an air conditioning unit having an indoor section that is separated from an outdoor section by a divider wherein each section has a fan and a heat exchanger coil. A housing is mounted behind the indoor coil that has a blind opening passing inwardly through the front wall of the housing which faces the indoor coil. The opening has a rectangular shaped upper section that extends laterally above the top of the coil and a volute shaped lower section that houses a centrifugal blower wheel having rearwardly curved blades and which opens upwardly through the bottom wall of the upper section. The lower section contains a scroll shaped wall that is generally centered about on the axis of the blower wheel whose radius of curvature increases from a cut off region at about the 2 o'clock blower location through an arc of about 200°. A second linear wall is positioned tangent with the distal end of the scroll wall and extends upwardly to intersect the bottom wall of the upper section of the opening to establish an exit region through which conditioned air that is drawn into the housing by the blower wheel is uniformly distributed across the upper section of the opening and is discharged back into the comfort region.

BRIEF DESCRIPTION OF THE DRAWING

For a better understanding of these and objects of the invention, reference will be made to the following detailed description of the invention which is to be read in connection with the accompanying drawing, wherein.

DETAILED DESCRIPTION OF THE INVENTION

Figure 1:
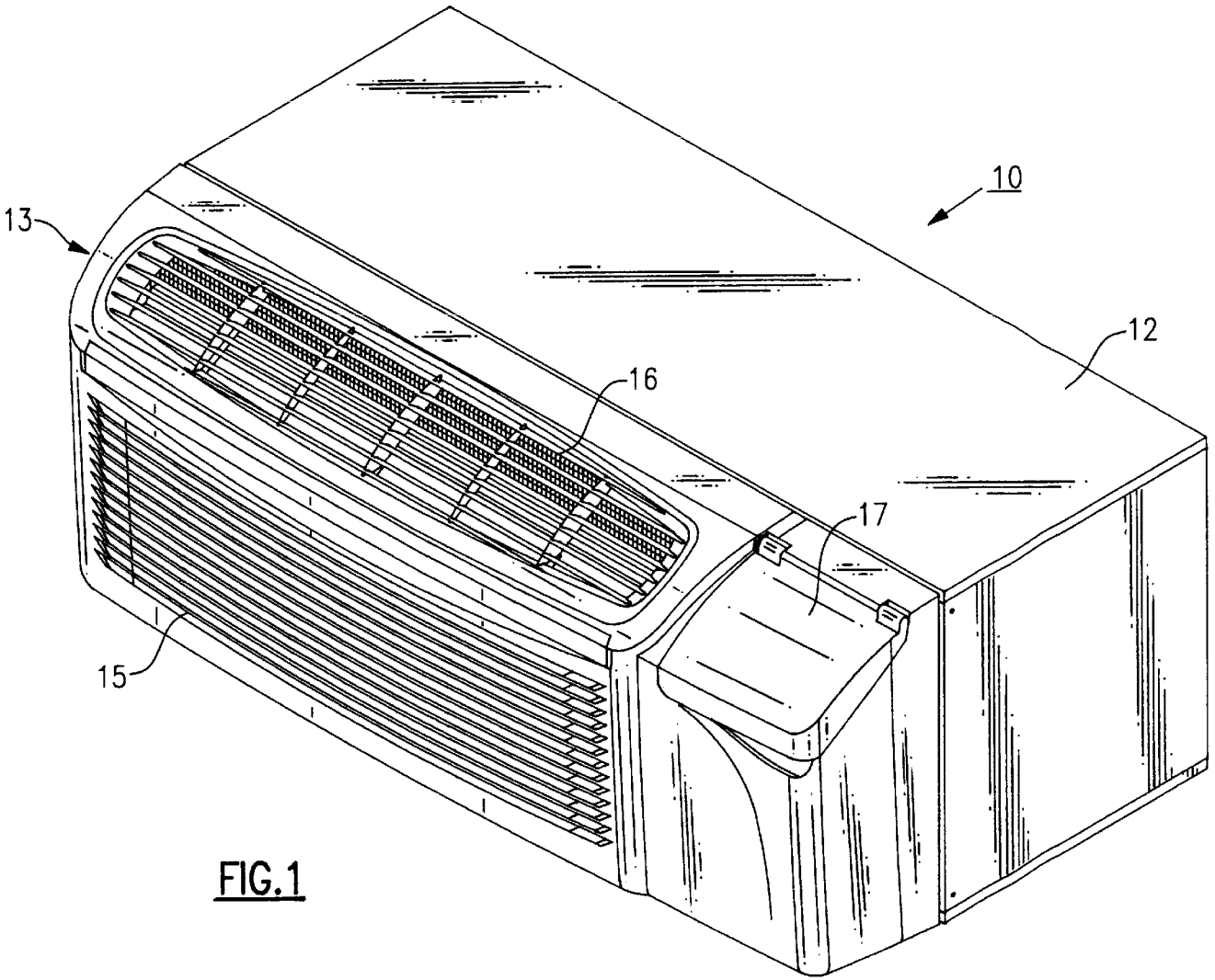
FIG. 1 is a front perspective view of a packaged terminal air conditioning unit embodying the teachings of the present invention.
Figure 2:
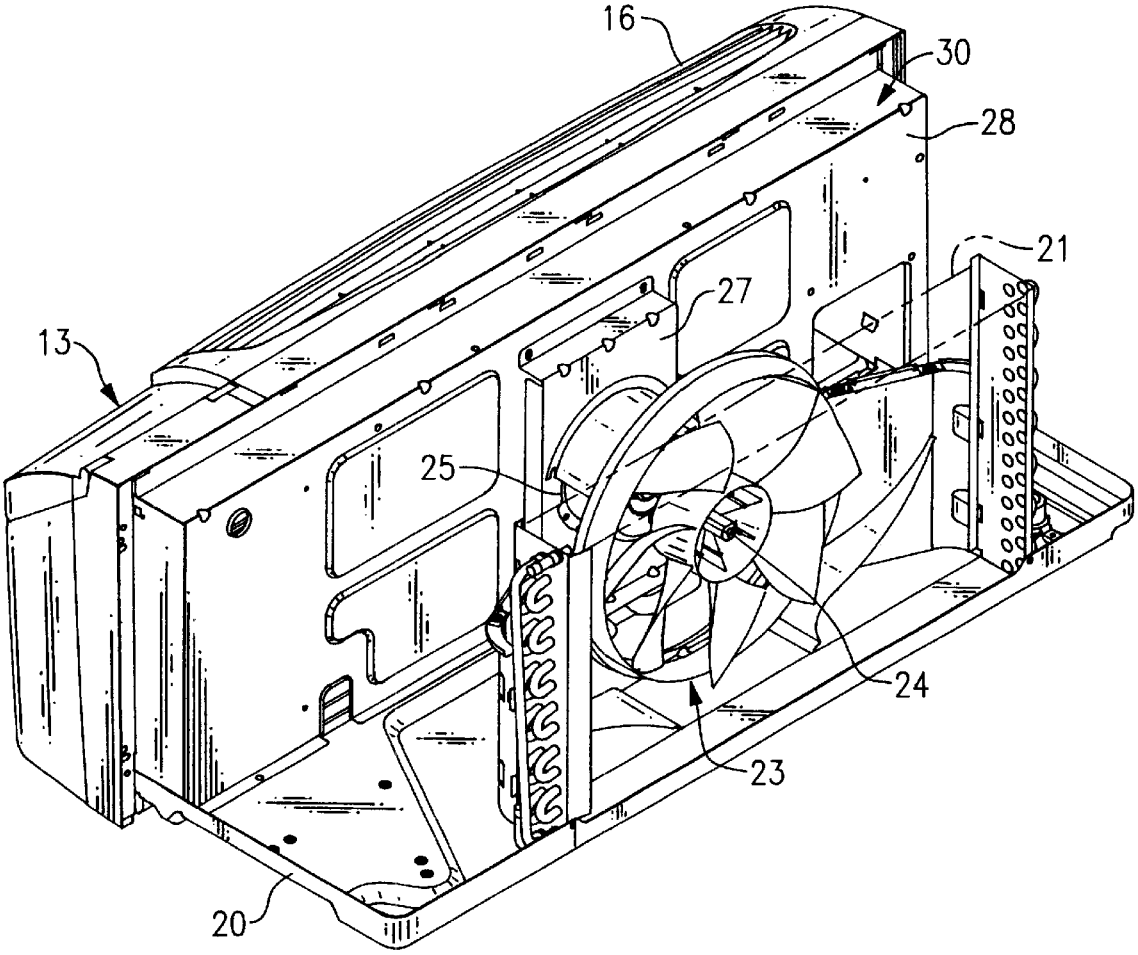
FIG. 2 is a rear perspective view of the air conditioning unit illustrated in FIG. 1 with the shell removed further to display the outdoor section of the unit.
Figure 3:
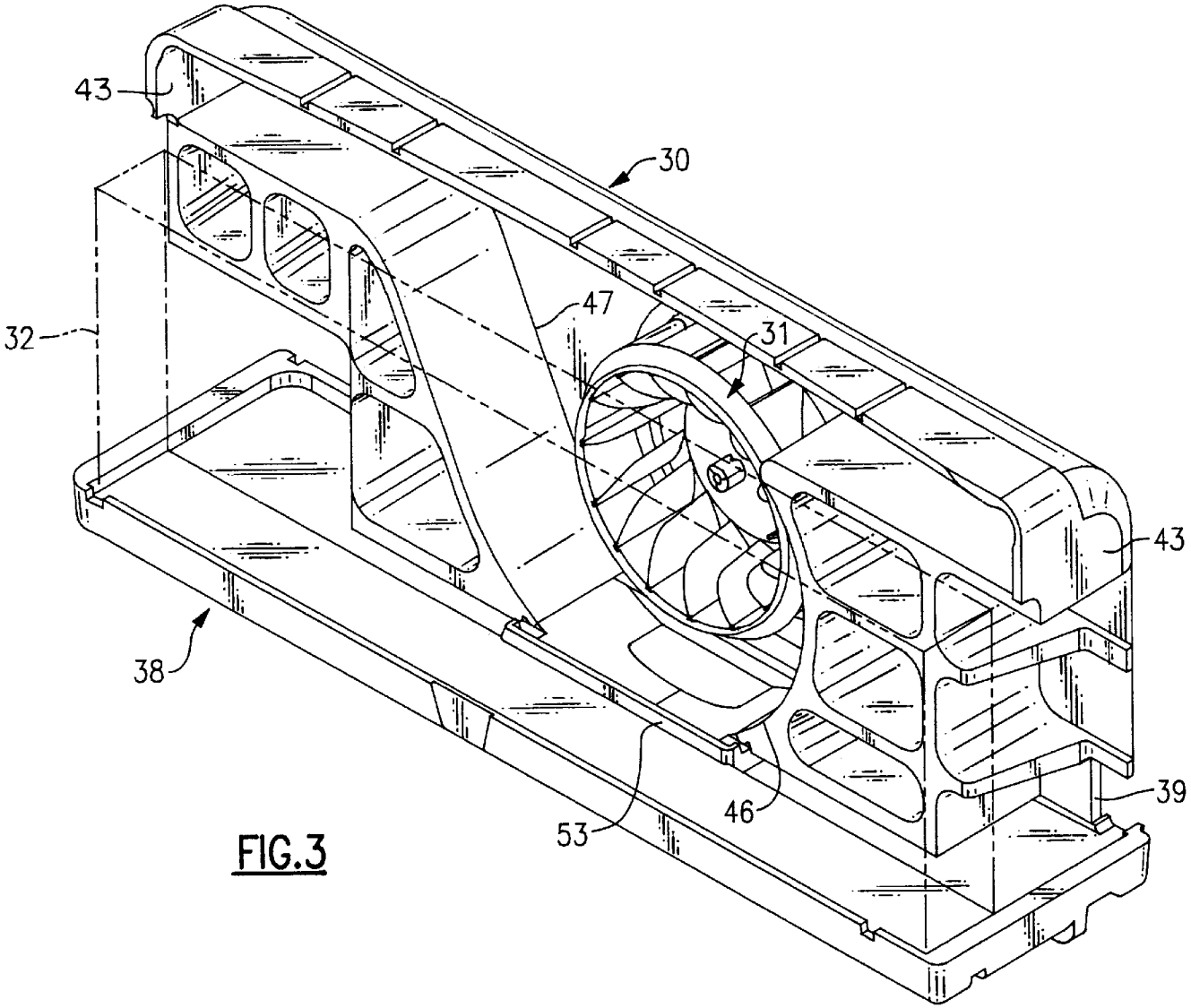
FIG. 3 is a front perspective view illustrating the indoor section of the unit.

Turning now to FIGS. 1–3, there is illustrated a packaged terminal air conditioner (PTAC) unit generally referenced 10, that embodies the teachings of the present invention. The unit is housed within a shell 12 that typically is mounted within an outside wall of a structure containing the comfort region that is serviced by the unit. The unit contains an indoor section and an outdoor section that are separated by a divider. Each section, in turn, includes a heat exchanger coil and a fan or blower wheel for moving air over the coil surfaces. A removable cover 13 is mounted at the front of the unit that closes against the shell which generally enclosed the indoor section of the unit. The cover includes a lower opening 15 through which return air from the comfort region is drawn into the unit and an upper opening 16 through which conditioned air is delivered back into the comfort region.

The unit controls are located in a recessed well beneath the front cover. Access to the controls is provided by a hinged door 17 mounted in the front cover.

FIG. 2 illustrates the outdoor section of the unit with parts removed for the sake of clarity. The component parts of the unit are mounted upon a base pan 20, and include the outdoor coil 21, a portion of which is shown in phantom outline. An outdoor fan 23 is mounted upon the rear shaft 24 of a drive motor 25 which, in turn, is supported in a mounting bracket 27. As will be explained in further detail below, the motor also includes a front shaft that is arranged to drive an indoor blower wheel that services the indoor coil. A vertical wall member 28 separates the outdoor section of the unit from the indoor section. A housing, generally referenced 30, is located on the indoor side of the wall and is secured to the pan adjacent to the wall.

Figure 4:
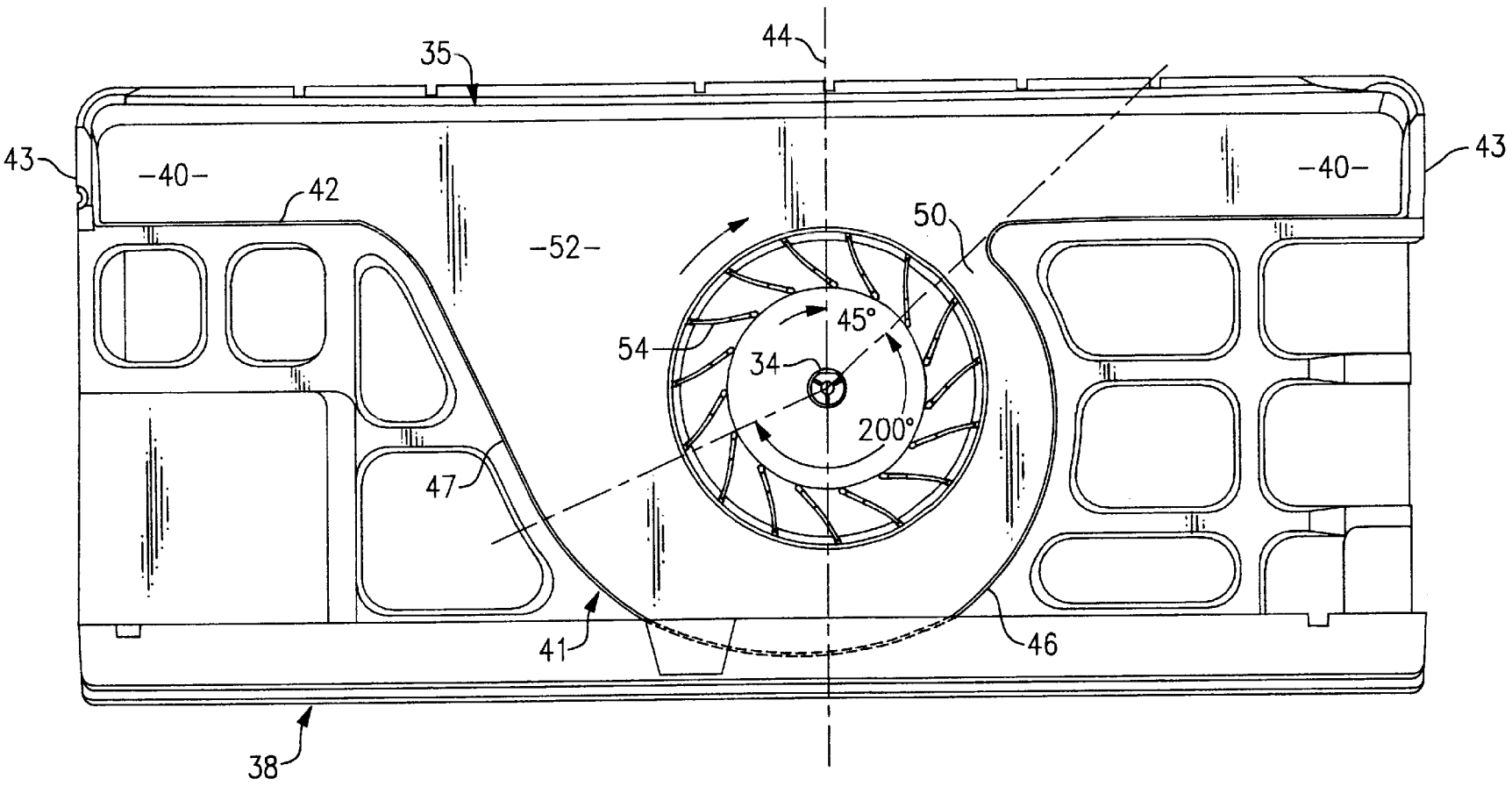
FIG. 4 is a front elevation illustrating the indoor blower and the housing in which the blower is contained.

The indoor centrifugal blower wheel 31 and the indoor coil 32 are shown in greater detail in FIGS. 3 and 4. The blower wheel is, as explained above, mounted for rotation upon the horizontally disposed front shaft 34 of motor 25. The blower wheel is contained within the previously noted housing within a blind opening 35 that passes inwardly through the front wall of the housing. The housing 30, along with the indoor coil 32 are both mounted upon an auxiliary pan 38 which, in assembly, is seated upon the floor of the main base pan 20. The blind opening in the front wall of the housing is closed off by a vertically disposed rear wall 39 and contains a rectangular shaped upper section 40 that extends substantially across the width of the housing and a volute shaped lower section 41 that opens upwardly into the upper section through the bottom wall 42 of the upper section. The opposed ends of the upper section of the opening are closed by end walls 43—43.

The main portion of the blower wheel is contained within the lower volute shaped section of the blind opening so that the tips of the blades 45 pass even with or slightly into the upper section of the opening as they move past the vertical axis 44 of the wheel. The volute shaped lower section of the opening is formed by a first spiral shaped wall 46 that is joined at its distal end by a linear inclined wall 47. The proximal end of the spiral wall intersects the bottom wall 42 of the upper opening at about the 45° wheel position. A cut off region 50 is established between the proximal end of the spiral wall and the blower wheel which prevents air from passing therethrough as the wheel turns in a clockwise direction. The center of the spiral is located at about the center of the wheel and increases in a clockwise direction. The spiral wall increases through an arc of about 200° from its proximal end to its distal end. The linear wall 47 is placed tangent to the distal end of the spiral wall and extends in an upward direction to intersect the bottom wall of the upper section of the opening to establish a wide discharge region.

A logarithmic spiral is described by the spiral wall of the lower opening. In order to accommodate the wall without disturbing the spiral, a portion of the wall passes downwardly into a well 53 formed in the auxiliary pan.

Figure 5:
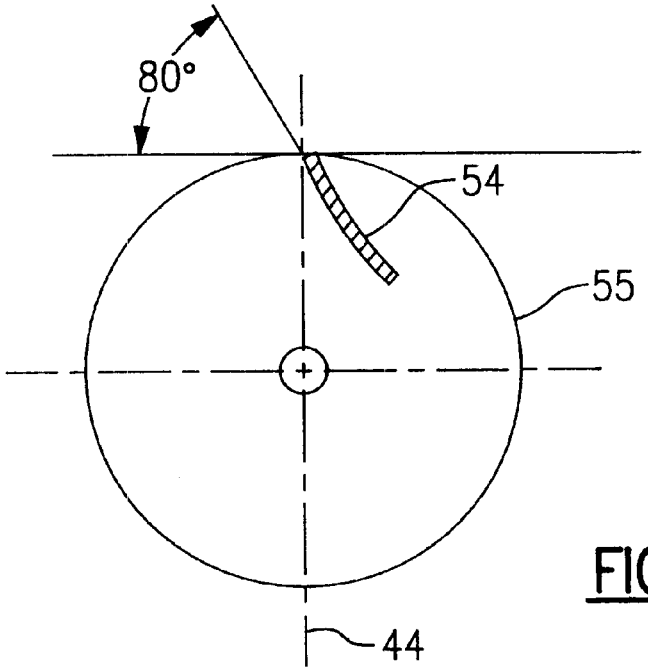
FIG. 5 is a schematic front view of the blower illustrating a generally radial blade suitable for use in one form of the invention.
Figure 6:
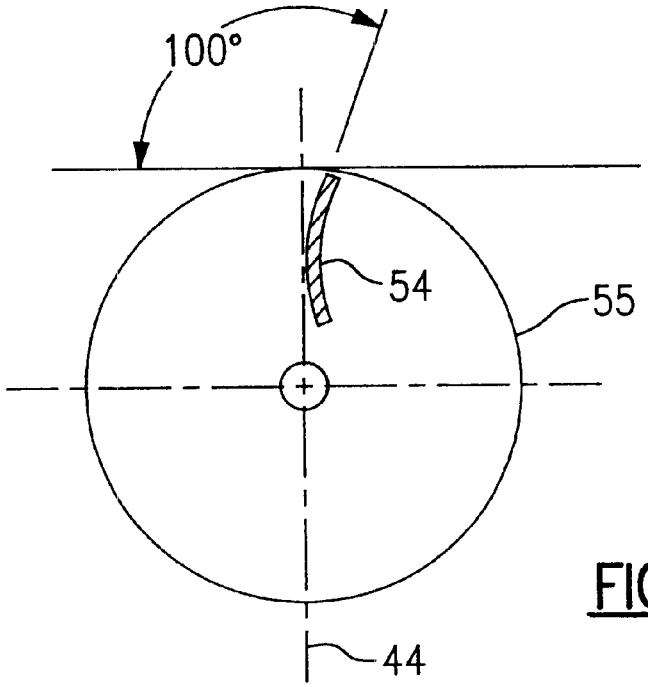
FIG. 6 is a schematic front view of the blower illustrating a rearwardly curved blade suitable for use in the present invention.

The blower wheel contains a series of spaced apart blades 54 that are radially or rearwardly curved as shown in FIGS. 5 and 6 so that the blades angle at the tip diameter 56 is between 80° and 100°. This, in turn, permits the blower wheel to operate at a higher speed when compared to prior art blower wheels that employ forwardly curved blades. The blower wheel is thus able to run at higher speeds to produce a high static pressure while, at the same time, producing less noise when compared to blowers found in the prior art.

The wheel in combination with the above described volute shaped lower section of the opening serves to uniformly distribute the flow leaving the wheel across the upper section of the opening. The upper section of the opening is situated at a height that is above the top of the indoor heat exchanger. The flow generated by the blower wheel is turned within the upper section of the opening and directed outwardly over the heat exchanger into the comfort region through the upper opening 16 located in the front cover of the unit. The back wall of the upper section is preferably arcuate in form and arranged to turn the flow toward the opening in the front cover.

Both the housing 30 and the auxiliary pan 36 are preferably cast from styrene to the desired shape.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for radially distributing the flow leaving a centrifugal blower wheel that includes:

a housing having a vertical front wall and a spaced apart vertical rear wall, said housing further including a blind opening passing inwardly through the front wall, so that the walls of the opening are perpendicular to the rear wall of the housing;

said opening containing an upper section that extends horizontally across said housing and a volute shaped lower section that opens into the upper section through a bottom wall of said upper section;

a blower wheel having radial or rearwardly curved blades mounted for rotation in said lower section of the opening about a horizontal axis;

said lower section of the housing opening containing a spiral shaped wall having a proximal end and a distal end, said proximal end of said spiral wall intersecting the bottom wall of said upper section adjacent to said blower wheel to form a restricted cutoff region between the blower wheel and the lower section of the opening, said spiral being centered about on the axis of said blower wheel and increasing from cutoff region through about 200° of arc to the distal end of said spiral wall, and an inclined wall that is tangent to the spiral wall at the distal end thereof, said inclined wall passing upwardly to intersect the bottom wall of said upper section of said opening to form an expanded exit region between the upper and lower sections of the opening.

2. The apparatus of claim 1 wherein the upper section has a rectangular cross sectional area.

3. The apparatus of claim 1 wherein said spiral shaped wall describes a logarithmic spiral.

4. The apparatus of claim 1 wherein said lower section of said opening intersects the bottom wall of the upper section of the opening in the cutoff region at an angle of 45° that is measured from the vertical axis of said blower wheel.

5. The apparatus of claim 1 wherein the housing is fabricated of polystyrene.

6. The apparatus of claim 1 wherein the tip of the blower wheel blades pass about level with the bottom wall of the upper section as the blower wheel turns.

7. The apparatus of claim 1 wherein the blades of the blower wheel are turned at an angle of between 80° and 100° as measured from a line that is tangent to the outside diameter of the blower wheel.

8. In an air conditioning unit having an indoor section that is separated from an outdoor section by a dividing wall, and wherein each section contains a heat exchanger and a means for moving air over the heat exchanger surface, apparatus for directing conditioned air from the indoor section into the comfort area serviced by the unit wherein said apparatus includes:

a housing mounted adjacent to the indoor heat exchanger in parallel alignment with the back of said heat exchanger, said housing having a vertical front wall facing the heat exchanger and a spaced apart vertical rear wall, said housing further including a blind opening passing inwardly through said front wall so that the walls of said opening are perpendicular to the rear wall, said opening containing an upper section that extends horizontally above the top of the indoor heat exchanger and a volute shaped lower section that opens into the upper section through a bottom wall of said upper section, a blower wheel having radial or rearwardly curved blades mounted for rotation in the lower section of said opening about a horizontal axis so that the blower draws conditioned air from said indoor heat exchanger;

said lower section of said opening containing a spiral shaped wall having a proximal end and a distal end, said proximal end intersecting the bottom wall of said upper section of the opening to form a restricted region between the blower wheel and the lower section of the opening, said spiral being centered about on the axis of the blower wheel and increasing from the proximal end to the distal end of said spiral wall through about 200° of arc, and an inclined wall that is tangent to the distal end of said spiral wall and which inclines upwardly to intersect the bottom wall of said upper section of said housing to form an expanded discharge region between the blower wheel and the lower section of the opening whereby comfort air drawn into the housing is distributed uniformly across the upper section of the opening and discharged over the top of the heat exchanger from the unit.

9. The unit of claim 8 wherein said heat exchanger and said housing are mounted upon an auxiliary pan.

10. The unit of claim 9 wherein both the housing and the auxiliary pan are fabricated of styrene.

11. The unit of claim 10 wherein said spiral wall passes downwardly through the top of said auxiliary pan.

12. The unit of claim 8 wherein the upper section of the opening has a rectangular cross section.

13. The unit of claim 8 wherein said spiral wall describes a logarithmic spiral.

14. The unit of claim 8 wherein said lower section of said opening intersects the bottom wall of the upper section at an angle of about 45° that is measured from the vertical axis of the wheel.

15. The unit of claim 1 wherein the tip of the blower wheel blades pass through a horizontal plane that is about level with the bottom wall of the upper section as the blower wheel turns.

16. The unit of claim 8 wherein the blades of the blower wheel are turned at ana angle of between 80° and 100° as measured from a line that is tangent to the outside diameter of the blower wheel.

* * * * *